US005708356A

United States Patent [19]

Onodera

[11] Patent Number: 5,708,356

[45] Date of Patent: Jan. 13, 1998

[54] APPARATUS FOR SUPPLYING STABILIZED POWER TO A LOAD HAVING VOLTAGE-CURRENT CHARACTERISTICS EXHIBITING PARTIAL NEGATIVE RESISTANCE

[75] Inventor: Toshihiro Onodera, Tokyo, Japan

[73] Assignee: Kabushiki Kaisha Toshiba, Kawasaki, Japan

[21] Appl. No.: 690,824

[22] Filed: Aug. 1, 1996

[30] Foreign Application Priority Data

Aug. 4, 1995 [JP] Japan ..... 7-199486

[51] Int. Cl.[6] ..... G05F 1/565

[52] U.S. Cl. ..... 323/275; 323/280; 315/DIG. 7

[58] Field of Search ..... 323/274, 275, 323/276, 280; 219/761, 716; 315/308, DIG. 5, DIG. 7

[56] References Cited

U.S. PATENT DOCUMENTS

| | | | |
|---|---|---|---|
| 4,187,448 | 2/1980 | Kuroi et al. | 315/176 |
| 4,839,832 | 6/1989 | Galler | 364/552 |
| 4,900,989 | 2/1990 | Suenaga et al. | 315/224 |
| 5,438,242 | 8/1995 | Simpson | 315/224 |
| 5,451,750 | 9/1995 | An | 219/716 |
| 5,576,940 | 11/1996 | Steigerwald et al. | 363/17 |

*Primary Examiner*—Peter S. Wong
*Assistant Examiner*—Derek J. Jardieu
*Attorney, Agent, or Firm*—Oblon, Spivak, McClelland, Maier & Neustadt, P.C.

[57] ABSTRACT

An electric power supply apparatus comprises a traveling-wave tube 15 exhibiting partial negative-resistance characteristics and a voltage stabilizing circuit for controlling a voltage control element 12 using an error amplifier 16 and a switch and for supplying stable power to the traveling-wave tube 15. In the apparatus, whether a traveling-wave tube 15 is in positive-resistance operation or negative-resistance operation is detected. In the negative-resistance operation, the control using the error amplifier 16 and the switch S1 is rendered ineffective.

9 Claims, 3 Drawing Sheets

APPARATUS FOR SUPPLYING STABILIZED POWER TO A LOAD HAVING VOLTAGE-CURRENT CHARACTERISTICS EXHIBITING PARTIAL NEGATIVE RESISTANCE

BACKGROUND OF THE INVENTION

1. Field of the Invention

The present invention relates to a power supply apparatus suited for supplying stabilized power to a load such as a traveling-wave tube incorporated in an artificial satellite and used in a communication system located in an outer space and to an ion engine mounted in an artificial satellite.

2. Description of the Related Art

A traveling-wave tube for use in space communication and the like transmit an input signal along an electronic beam. While being transmitted, the input signal gains energy from the beam and is amplified. The traveling-wave tube has a plurality of electrodes for controlling, accelerating or collecting the electronic beam. When a voltage is applied to one electrode, voltage-current characteristics of the other electrodes exhibit negative resistance.

The traveling-wave tube is usually connected to and supplied with stabilized power from a voltage stabilizing circuit constituting a power supply apparatus. The voltage stabilizing circuit includes a voltage control element and a negative feedback circuit. The negative feedback circuit controls the voltage control element in accordance with variations in load voltage applied to the traveling-wave tube. Since the tube is connected to the voltage stabilizing circuit, the operation of the voltage stabilizing circuit sometimes becomes unstable in a negative-resistance region and then the tube oscillates. This region, where the voltage-current characteristics of the tube exhibit negative resistance, is limited. However, when power-supply voltage is applied, negative resistance occurs, resulting in the oscillation of the traveling-wave tube.

To prevent the unstable operation of the voltage stabilizing circuit, resistors having resistance lower than the negative resistance of the load may be used as dummies, connected to the power supply in parallel. However, this method is disadvantageous in that the power is consumed by the resistors connected as dummies to thereby impair the efficiency of the circuit.

This problem is not limited to the traveling-wave tubes wherein voltage-current characteristics partially exhibit negative resistance. It is inherent to a load wherein voltage-current characteristics exhibit partial negative resistance, such as an ion engine or the like mounted in an artificial satellite for controlling the orbit of the satellite.

SUMMARY OF THE INVENTION

The object of the present invention is therefore to provide a power supply apparatus capable of precisely, reliably and effectively supplying power to a load wherein voltage-current characteristics partially exhibit negative resistance.

To attain this object, the power supply apparatus of the present invention is characterized by comprising a load exhibiting partial negative-resistance characteristics; a power supply for supplying power to the load; a voltage control element for controlling voltage of the power supplied to the load from the power supply; detecting means for detecting whether voltage-current characteristics of the load exhibit a state of negative resistance operation; and voltage stabilizing means including a negative feedback circuit controlling the voltage control element in accordance with variations in load voltage applied to the load, wherein control of the negative feedback circuit is rendered ineffective in a state of negative-resistance operation detected by the detecting means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

The embodiments of the present invention will now be described in detail, while referring to the appended drawings.

Figure 1:
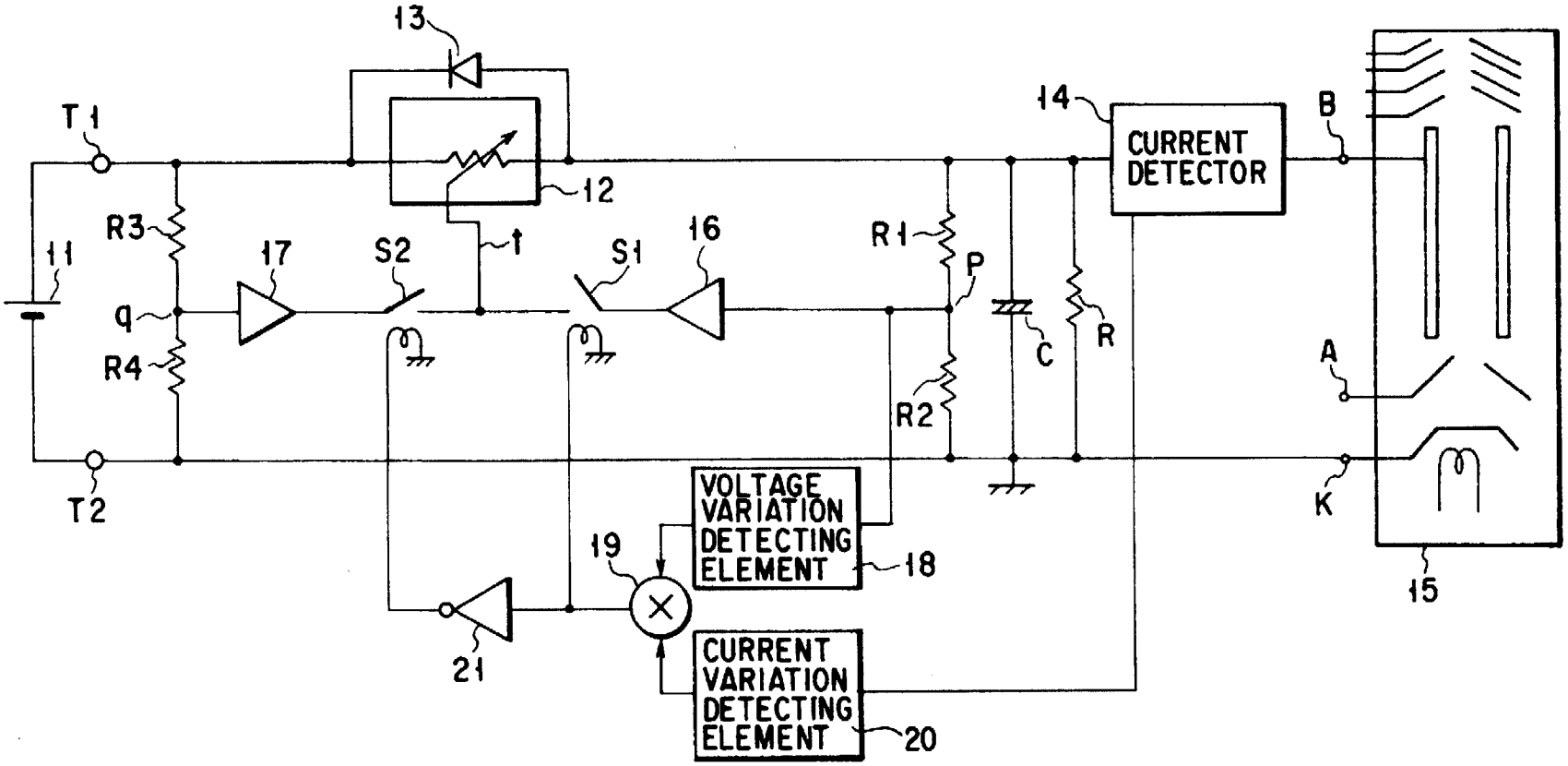
FIG. 1 is a circuit diagram illustrating a power supply apparatus according to the first embodiment of the present invention.

FIG. 1 shows a power supply apparatus according to the first embodiment of the present invention. A traveling-wave tube exhibiting partial negative resistance characteristics is used as a load.

Reference numeral 11 denotes a power supply. The power supply 11 is connected to a voltage stabilizing circuit via terminals T1 and T2. The terminal T1 is connected to a voltage control element 12. A Zener diode 13 is connected in parallel with the voltage control element 12 for protection purposes. The voltage control element 12 is connected to a current detector 14. The current detector 14 is connected to the load of the voltage stabilizing circuit, for example, the body electrode B of the traveling-wave tube 15 for space communication. The traveling-wave tube 15 has an anode electrode A and a cathode electrode K in addition to the body electrode B. The cathode electrode K is connected to the terminal T2.

Between the cathode electrode K of the traveling-wave tube 15 and the current detector 14, a breeder resistor R, a smoothing capacitor C and output voltage dividing resistors R3, R4 are connected in parallel. Power supply voltage dividing resistors R3 and R4 are connected in parallel to the power supply 11.

An error amplifier 16 constituting a negative feedback circuit and a switch S1 with a cutoff control terminal are connected in due order to a voltage division point p between the output voltage dividing resistors R1 and R2. A terminal T of the voltage control element 12 is connected to the switch S1.

An error amplifier 17 constituting a forward circuit and a switch S2 with a cutoff control terminal are connected in due order to a voltage division point q between the power supply voltage dividing resistors R3 and R4. The control terminal t of the voltage control element 12 is connected to the switch S2.

The voltage division point p between the output voltage dividing resistors R1 and R2 is connected to a voltage variation detecting element 18 for detecting variations in the voltage of the voltage division point p. The voltage variation detecting element 18 is connected to a multiplier 19.

The current detector 14 is connected to a current variation detecting element 20 for detecting variations in the current flowing across the body electrode B. The multiplier 19 is connected to the current variation detecting element 20. The switch S1 is connected to the multiplier 19. In addition, the switch S2 is connected to the multiplier 19 via an inverter 21.

Figure 2:
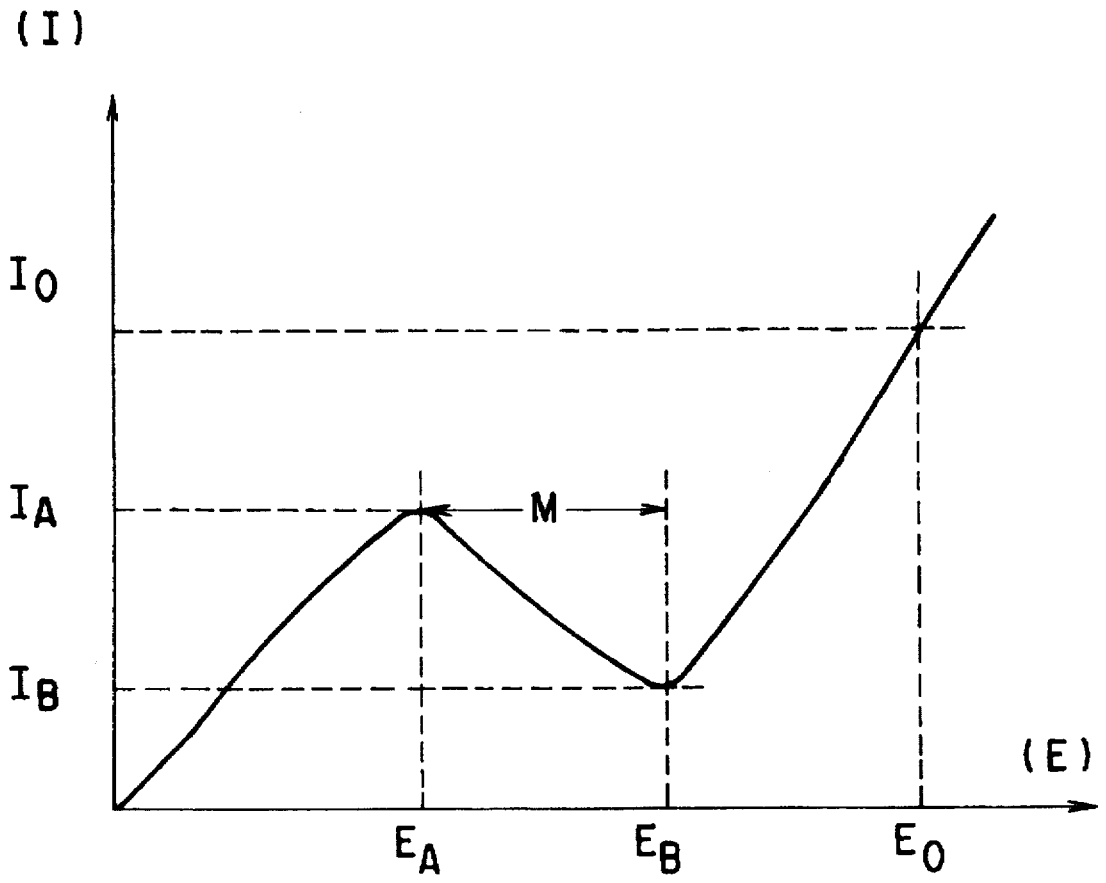
FIG. 2 is a characteristic diagram to explain the operation of the circuit of FIG. 1.

The traveling-wave tube 15 has voltage-current characteristics between the body electrode B and the cathode electrode K exhibiting negative resistance in a region M as shown in FIG. 2. In the graph, the axis of ordinate is body current (I) and the axis of abscissa is body voltage (E).

According to the graph of FIG. 2, body currents IA, IB and I0 correspond to body voltages EA, EB and E0, respectively. Each of the voltage variation detecting element 18 and the current variation detecting element 20 outputs a +1-volt signal if a variation in the inputted signal is positive, and a 0-volt signal if negative.

Next, the operation of the above circuit arrangement will be described.

If the power supply 11 is turned on, the voltage (to be referred to as 'load voltage' hereinafter) between the body electrode B and the cathode electrode K increases. So does the current (to be referred to as 'load current' hereinafter) between the body electrode B and the cathode electrode K. The load voltage and load current are on the increase until the load voltage becomes EA. The output of the voltage variation detecting element 18 and that of the current variation detecting element 20 are both +1 volt. The output of the multiplier 19 is 1 volt. As a result, the switch S1 is closed. The output of the multiplier 19 is, meanwhile, inverted at the inverter 21 and the output of the inverter 21 is 0 volt. The switch S2 remains opened.

When the switch S1 is closed, a variation (in this case, an increase) in the voltage of the voltage division point p between the output voltage dividing resistors R1 and R2 are amplified at the error amplifier 16. The amplified variation is added as a control signal to the control terminal t of the voltage control element 12. A negative feedback circuit is thus formed to, for example, control the resistance of the voltage control element 12 to increase and the load voltage to decrease.

Thereafter, the load voltage becomes between EA and EB, that is, the load voltage is in a region M. There, the load voltage increases while the load current decreases. Thus, the output of the current variation detecting element 20 is 0 volt and that of the multiplier 19 is also 0 volt. In this state, the switch S1 is opened to cut off the negative feedback circuit.

When the output of the multiplier 19 is 0 volt, the output of the multiplier 19 is inverted at the inverter 21. The output of the inverter 21 is 1 volt and the switch S2 is closed. In this state, a variation (in this case, an increase) in the voltage of the voltage division point q between the power-supply voltage dividing resistors R3 and R4 is amplified at the error amplifier 17. The amplified variation is added as a control signal to the control terminal t of the voltage control element 12, thus forming a feedforward circuit.

The resistance of the voltage control element 12 is controlled to increase and the load voltage is controlled to decrease by the feedforward circuit. The feedforward circuit causes the load voltage to increase while maintaining the stable operation of the voltage stabilizing circuit. In this case, the control of the negative feedback is stopped. Due to this, even if the voltage-current characteristics of the traveling-wave tube 15 exhibiting partial negative resistance, the voltage stabilizing circuit operates stable and the tube does not oscillate.

When the load voltage exceeds EB, the output of the current variation detecting element 20 varies to +1 volt. As a result, the switch S1 is closed and the switch S2 is opened, thus providing negative feedback control. Thereafter, the operation of the load voltage reaches a predetermined value E0 and the voltage stabilizing circuit reaches a stable state.

According to the above-described construction, while power conversion efficiency is kept high, the operation of the voltage stabilizing circuit can be made stable in region M where the voltage-current characteristics of the traveling-wave tube 15 exhibit negative resistance. At the beginning of the application of the voltage to the traveling-wave tube 15, the oscillation of the tube 15 can be reliably prevented and stable transmission of the inputted signal can be realized.

Figure 3:
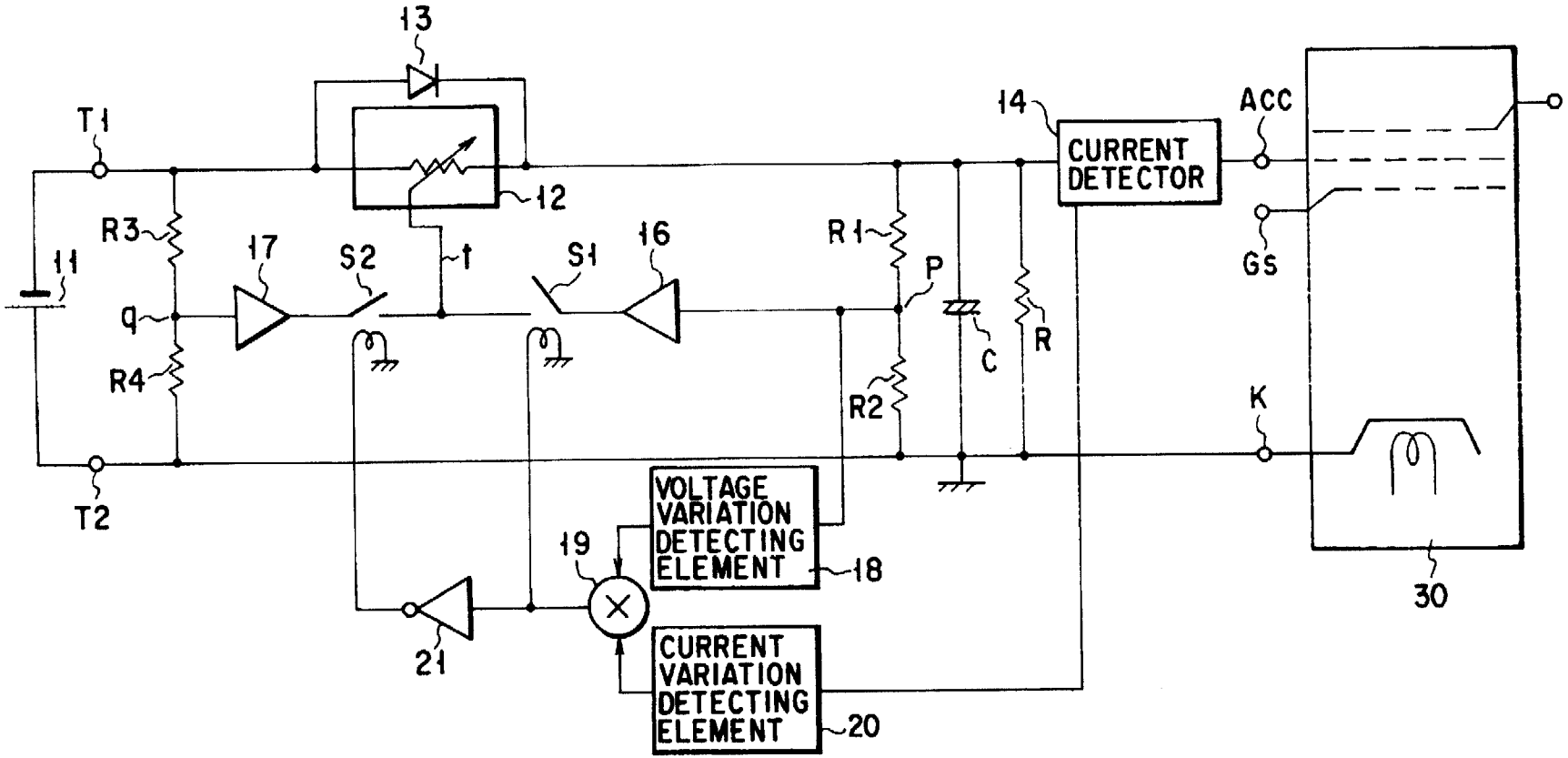
FIG. 3 is a circuit diagram illustrating a power supply apparatus according to another embodiment of the present invention.

The present invention is not limited to the above embodiment. As shown in FIG. 3, for example, the same advantage can be produced if an electric propulsion type ion engine 30 whose voltage-current characteristics partially exhibit negative resistance is used as a load. In FIG. 3, the same reference numerals as those in FIG. 1 denote the same element except for an ion engine 30. The detailed description thereof is thus not given here.

The ion engine 30 serving as a load is applied to electric propulsion means for controlling the orbit of a space navigator such as an artificial satellite. The frame of the ion engine 30 is filled with plasma such as xenon (Xe+). An electronic beam is transmitted from the cathode electrode K to the accelerator grid electrode (Acc) of the ion engine 30. As a result, the xenon gas plasma filled in the frame gains energy from the electronic beam and is amplified. The plasma is accelerated and go out of the grid of the accelerator grid electrode (Acc), thereby producing desired propulsion.

The ion engine 30 has the accelerator grid electrode Acc, a start grid electrode Gs and the cathode electrode K for controlling, accelerating and collecting electronic beams. The voltage applied between the accelerator grid electrode (Acc) and the cathode electrode K causes the ion engine 30 to have the same voltage-current characteristics exhibiting partial negative resistance as those of the traveling-wave tube 15.

According to the embodiments described so far, the negative feedback circuit is cut off and the feed forward circuit controls the resistance of the voltage control element and the load voltage in a region where the voltage-current characteristics of the traveling-wave tube 15 and the ion engine 30 exhibit negative resistance. However, the period for the voltage is in the negative-resistance region is short, it is possible to temporarily stop the control of the negative feedback circuit without using a feedforward circuit. In this construction, power conversion efficiency can be kept high and the operation of the voltage stabilizing circuit can be made stable.

The present invention is not, of course, limited to the above embodiments but is applicable to other embodiments without departing from the spirit of the present invention.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An electric power supply apparatus comprising:

a load exhibiting partial negative-resistance characteristics;

a power supply for supplying power to the load;

a voltage control element for controlling voltage of the power supplied to the load from the power supply;

detecting means for detecting whether voltage-current characteristics of the load exhibit a state of negative resistance operation; and voltage stabilizing means including a negative feedback circuit controlling the voltage control element in accordance with variations in load voltage applied to the load, wherein control of the negative feedback circuit is rendered ineffective in a state of negative-resistance operation detected by the detecting means.

2. An apparatus according to claim 1, wherein the load is a traveling-wave tube.

3. An apparatus according to claim 1, wherein the load is an ion engine.

4. An electric power supply apparatus comprising:

a load exhibiting partial negative-resistance characteristics;

a power supply for supplying power to the load;

a voltage control element for controlling voltage of the power supplied to the load from the power supply;

detecting means for detecting whether voltage-current characteristics of the load exhibit a state of negative-resistance operation or a state of positive-resistance operation;

voltage stabilizing means, including a negative feedback circuit for controlling the voltage control element in accordance with variations in load voltage applied to the load and a feedforward circuit for controlling the voltage control element in accordance with variations in the voltage applied to the voltage control element, for controlling the voltage control element using the negative feedback circuit in a state of positive-resistance operation detected by the detecting means and for controlling the voltage control element using the feedforward circuit in a state of negative-resistance operation detected by the detecting means.

5. An apparatus according to claim 4, wherein the load is a traveling-wave tube.

6. An apparatus according to claim 4, wherein the load is an ion engine.

7. An apparatus according to claim 4, wherein the detecting means comprises:

a voltage detecting element for detecting load voltage applied to the load;

a current detecting element for detecting load current flowing across the load; and a multiplier for multiplying variations in the load voltage detected by the voltage detecting element by variations in the load current detected by the current detecting element.

8. An apparatus according to claim 4, wherein the negative feedback circuit includes:

an error amplifier for amplifying variations in the load voltage applied to the load; and a switch with a cutoff control terminal, connected between the error amplifier and the voltage control element and opened and closed in accordance with detection results of the detecting means.

9. An apparatus according claim 4, wherein the feedforward circuit includes:

an error amplifier for amplifying variations in the voltage applied to the voltage control element; and a switch with a cutoff control terminal, connected between said error amplifier and the voltage control element and opened and closed in accordance with detection results of the detecting means.

* * * * *